US011092907B2

(12) United States Patent
Mizobe et al.

(10) Patent No.: US 11,092,907 B2
(45) Date of Patent: Aug. 17, 2021

(54) TONER

(71) Applicant: KYOCERA Document Solutions Inc., Osaka (JP)

(72) Inventors: Takeo Mizobe, Osaka (JP); Takeshi Arakawa, Osaka (JP); Masanori Sugahara, Osaka (JP); Ryota Kobayashi, Osaka (JP); Kazuki Ono, Osaka (JP); Naruo Yabe, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/850,085

(22) Filed: Apr. 16, 2020

(65) Prior Publication Data

US 2020/0341399 A1 Oct. 29, 2020

(30) Foreign Application Priority Data

Apr. 24, 2019 (JP) ..... JP2019-083051

(51) Int. Cl.
*G03G 9/08* (2006.01)
*G03G 9/097* (2006.01)

(52) U.S. Cl.
CPC ..... *G03G 9/09716* (2013.01); *G03G 9/0819* (2013.01); *G03G 9/09708* (2013.01)

(58) Field of Classification Search
CPC ..... G03G 9/09716; G03G 9/09708
USPC ..... 430/108.6
See application file for complete search history.

(56) References Cited

U.S. PATENT DOCUMENTS 10,168,630 B2 1/2019 Uchino et al.
2018/0267416 A1 9/2018 Uchino et al.

FOREIGN PATENT DOCUMENTS

JP 2018-155912 A 10/2018

*Primary Examiner* — Mark A Chapman
(74) *Attorney, Agent, or Firm* — Studebaker & Brackett PC

(57) ABSTRACT

A toner contains toner particles. The toner particles each include a toner mother particle containing a binder resin and an external additive attached to a surface of the toner mother particle. The external additive contains titanate compound particles doped with lanthanum and a group 5 element in the periodic table as external additive particles. The amount of the lanthanum is at least 1.50% by mass relative to the total mass of the titanate compound particles. The amount of the group 5 element in the periodic table is at least 0.01% by mass and no greater than 0.60% by mass relative to the total mass of the titanate compound particles.

10 Claims, 1 Drawing Sheet

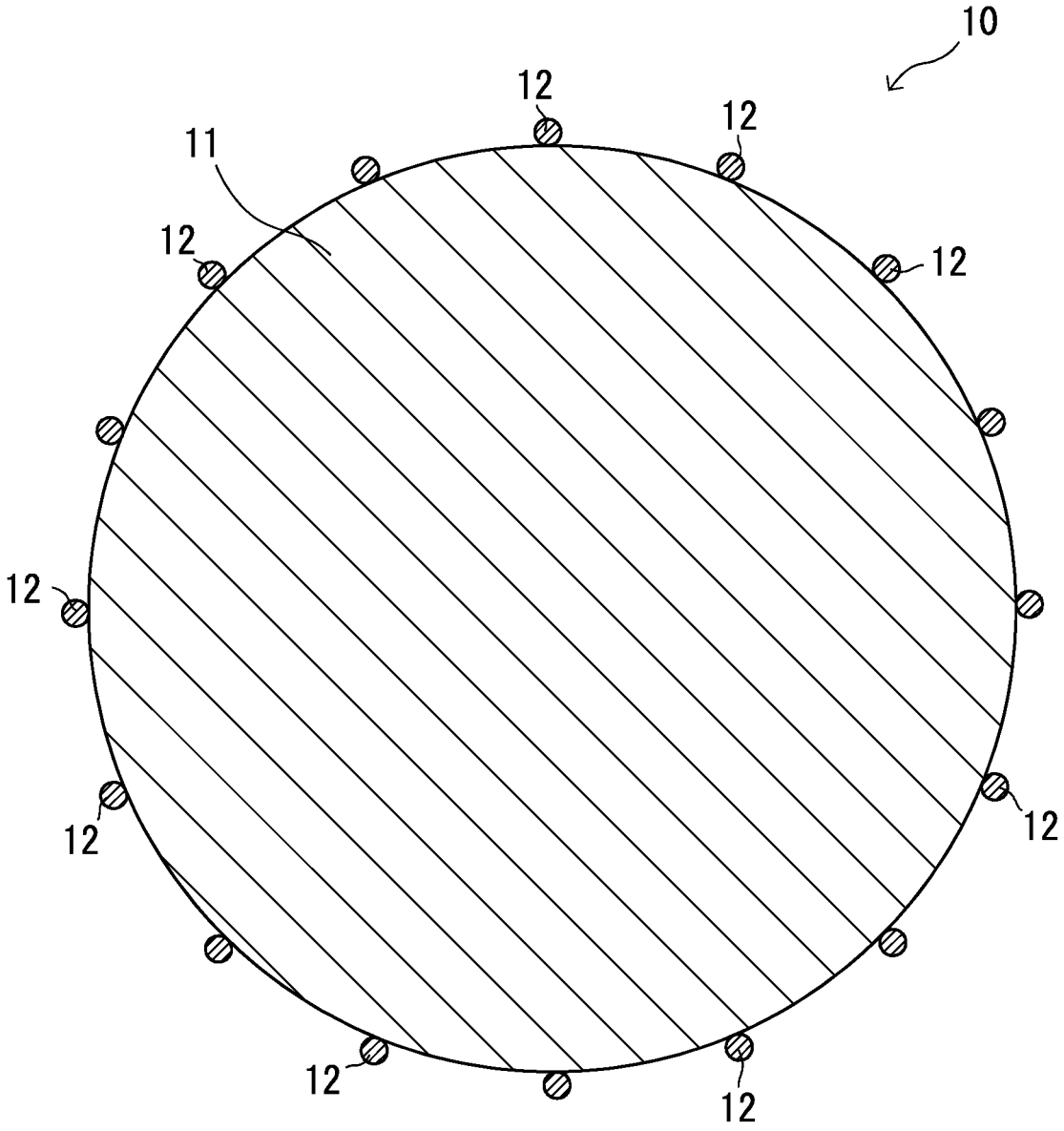
10
11
12
12
12
12
12
12
12
12
12

TONER

INCORPORATION BY REFERENCE

The present application claims priority under 35 U.S.C. § 119 to Japanese Patent Application No. 2019-083051, filed on Apr. 24, 2019. The contents of this application are incorporated herein by reference in their entirety.

BACKGROUND

The present disclosure relates to a toner.

An image forming apparatus that forms an image using a toner is required to be able to constantly form an image having an image density of a specific level or higher even after printing on a large number of sheets. Therefore, toners containing titanate compound particles (more specifically, strontium titanate particles or the like) as external additive particles have been studied. Titanate compounds have a relatively high relative dielectric constant and therefore contribute to maintenance of constant charge amount of toner even after printing on a large number of sheets. Therefore, when a toner containing titanate compound particles as external additive particles is used, constant image formation with an image density of a specific level or higher can be achieved even after printing on a large number of sheets.

However, titanate compound particles generally each have a polyhedral shape (specifically, a polyhedral shape having corners). For this reason, a surface of a photosensitive drum may be excessively polished by the titanate compound particles through printing on a large number of sheets, for example. Excessive polishing of the surface of the photosensitive drum may cause image defects (streaks).

In order to inhibit excessive polishing of the surface of the photosensitive drum, for example, titanate compound particles doped with lanthanum (also referred to below as lanthanum-doped titanate compound particles) are used as external additive particles. Since the lanthanum-doped titanate compound particles have an almost spherical shape, use of a toner containing the lanthanum-doped titanate compound particles as external additive particles can inhibit excessive polishing of the surface of the photosensitive drum.

SUMMARY

A toner according to an aspect of the present disclosure contains toner particles. The toner particles each include a toner mother particle containing a binder resin and an external additive attached to a surface of the toner mother particle. The external additive contains titanate compound particles doped with lanthanum and a group 5 element in the periodic table as external additive particles. The amount of the lanthanum is at least 1.50% by mass relative to the total mass of the titanate compound particles. The amount of the group 5 element in the periodic table is at least 0.01% by mass and no greater than 0.60% by mass relative to the total mass of the titanate compound particles.

BRIEF DESCRIPTION OF THE DRAWING

FIGURE is a diagram illustrating an example of a sectional structure of a toner particle included in a toner according to an embodiment of the present disclosure.

DETAILED DESCRIPTION

The following describes a preferable embodiment of the present disclosure. First, the terminology used in the present specification will be described. A toner is a collection (for example, a powder) of toner particles. An external additive is a collection (for example, a powder) of external additive particles. Unless otherwise stated, evaluation results (for example, values indicating shape and physical properties) for a powder (specific examples include a powder of toner particles and a powder of external additive particles) are each a number average of values measured for a suitable number of particles selected from the powder.

A value for volume median diameter ($D_{50}$) of a powder is a median of diameter by volume measured using a laser diffraction/scattering particle size distribution analyzer ("LA-950", product of Horiba, Ltd.), unless otherwise stated. A value for number average primary particle diameter of a powder is a number average of equivalent circle diameters of 100 primary particles (Heywood diameter: diameters of circles having the same areas as projected areas of the primary particles) measured using a scanning electron microscope ("JSM-7401F", product of JEOL Ltd.) and image analysis software ("WinROOF", product of MITANI CORPORATION), unless otherwise stated. Note that a number average primary particle diameter of particles refers to a number average primary particle diameter of particles of a powder (number average primary particle diameter of the powder), unless otherwise stated.

A level of chargeability refers to a level of susceptibility to triboelectric charging, unless otherwise stated. A measurement target (for example, a toner) is triboelectrically charged for example by mixing and stirring the measurement target with a standard carrier (N-01: a standard carrier for a negatively chargeable toner, P-01: a standard carrier for a positively chargeable toner) provided by The Imaging Society of Japan. An amount of charge of the measurement target is measured before and after triboelectric charging using for example a compact draw-off charge measurement system ("MODEL 212HS", product of TREK, Inc.). A measurement target having a larger change in amount of charge before and after the triboelectric charging has stronger chargeability.

A value for a softening point (Tm) is measured using a capillary rheometer ("CFT-500D", product of Shimadzu Corporation), unless otherwise stated. On an S-shaped curve (horizontal axis: temperature, vertical axis: stroke) plotted using the capillary rheometer, the softening point (Tm) is a temperature corresponding to a stroke value of "(base line stroke value+maximum stroke value)/2".

Unless otherwise stated, a "main component" of a material refers to a component contained the most in the material in terms of mass.

A level of hydrophobicity can be expressed for example by a contact angle of a water drop (wettability of water). A larger contact angle of a water drop indicates higher hydrophobicity. Hydrophobization refers to a treatment for increasing hydrophobicity.

An alkyl group having a carbon number of at least 3 and no greater than 8 as used herein is an unsubstituted straight chain or branched chain alkyl group. Examples of the alkyl group having a carbon number of at least 3 and no greater than 8 include an n-propyl group, an n-butyl group, an isobutyl group, an n-pentyl group, an n-hexyl group, an n-heptyl group, and an n-octyl group.

The "periodic table" refers to a long period periodic table of elements in accordance with the definition specified by IUPAC (International Union of Pure and Applied Chemistry). The "group 5 element in the periodic table" refers to at least one element selected from the group consisting of vanadium (V), niobium (Nb), tantalum (Ta), and dubnium (Db). The "titanate compound" refers to a compound (crystal) containing at least titanium, oxygen, and a metallic element other than titanium. The "titanate compound particles" refers to particles containing a titanate compound as a main component. The content of the titanate compound in the titanate compound particles is preferably at least 99% by mass and no greater than 100% by mass relative to the total mass of the titanate compound particles.

In the following description, the term "-based" may be appended to the name of a chemical compound in order to form a generic name encompassing both the chemical compound itself and derivatives thereof. When the term "-based" is appended to the name of a chemical compound used in the name of a polymer, the term indicates that a repeating unit of the polymer originates from the chemical compound or a derivative thereof.

In the following description, "doped with an element (more specifically, lanthanum, a group 5 element in the periodic table, or the like)" refers to partial substitution of an element constituting the crystal of the titanate compound as a substrate with an element different from the element constituting the substrate (more specifically, with lanthanum, a group 5 element in the periodic table, or the like).

<Toner>

A toner according to the present embodiment is suitable for example for use as a positively chargeable toner in electrostatic latent image development. The toner according to the present embodiment is a collection (for example, a powder) of toner particles (particles each having features described later). The toner may be used as a one-component developer. Alternatively, the toner may be mixed with a carrier using a mixer (for example, a ball mill) to prepare a two-component developer.

The toner particles included in the toner according to the present embodiment each include a toner mother particle containing a binder resin and an external additive attached to the toner mother particle. The external additive contains titanate compound particles doped with lanthanum and a group 5 element in the periodic table as external additive particles (also referred to below as specific titanate compound particles). The amount of lanthanum is at least 1.50% by mass relative to the total mass of the specific titanate compound particles. The amount of the group 5 element in the periodic table is at least 0.01% by mass and no greater than 0.60% by mass relative to the total mass of the specific titanate compound particles.

An amount of lanthanum relative to the total mass of the specific titanate compound particles may be referred to below as simply an "amount of lanthanum". Similarly, an amount of the group 5 element in the periodic table relative to the total mass of the specific titanate compound particles may be referred to below as simply an "amount of the group 5 element in the periodic table". Note that an amount of lanthanum relative to the total mass of the specific titanate compound particles is synonymous with a content ratio of lanthanum to the total mass of the specific titanate compound particles. Similarly, an amount of the group 5 element in the periodic table relative to the total mass of the specific titanate compound particles is synonymous with a content ratio of the group 5 element in the periodic table to the total mass of the specific titanate compound particles. Both the amount of lanthanum and the amount of the group 5 element in the periodic table are measured using an inductively coupled plasma (ICP) spectrometer.

As a result of the toner according to the present embodiment having the above-described features, a high-quality image can be formed even after printing on a large number of sheets (for example, 20,000 sheets) while inhibiting occurrence of fogging. The reason is presumed as follows.

Usually, when external additive particles having an almost spherical shape are used, the external additive particles tend to be excessively charged. Excessively charged external additive particles may discharge, for example, to a surface of a photosensitive drum during printing on a large number of sheets (for example, 20,000 sheets), and may cause dielectric breakdown in the surface of the photosensitive drum. Dielectric breakdown tends to occur particularly in a low-temperature and low-humidity environment. When dielectric breakdown occurs in the surface of the photoconductor drum, the surface of the photoconductor drum may be damaged. Damage to the surface of the photosensitive drum caused by dielectric breakdown causes image defects (production of black spots). Accordingly, when lanthanum-doped titanate compound particles are used as external additive particles, image defects (black spots) are likely to be produced when an image is formed after printing on a large number of sheets.

By contrast, in the toner according to the present embodiment, specific titanate compound particles doped with a group 5 element in the periodic table are used as external additive particles. Group 5 elements in the periodic table have a moderately low electric resistance. The amount of the group 5 element in the periodic table is at least 0.01% by mass. Therefore, the specific titanate compound particles can be inhibited from being excessively charged in the toner according to the present embodiment. The specific titanate compound particles are doped with lanthanum in addition. The amount of lanthanum is at least 1.50% by mass. Therefore, with use of the toner according to the present embodiment, excessive polishing of the surface of the photosensitive drum can be inhibited, for example. Further, the specific titanate compound particles contain a titanate compound having a relatively high relative dielectric constant and therefore contribute to maintenance of a constant charge amount of the toner even after printing on a large number of sheets.

Accordingly, with use of the toner according to the present embodiment, even after printing on a large number of sheets (for example, 20,000 sheets), an image having an image density of a specific level or higher can be constantly formed while production of image defects (specific examples include production of black spots, and production of streaks) is inhibited. Therefore, with use of the toner according to the present embodiment, a high-quality image can be formed even after printing on a large number of sheets (for example, 20,000 sheets).

Generally, when external additive particles having a low electric resistance are used, fogging is likely to occur. Fogging tends to occur particularly in a high-temperature and high-humidity environment.

By contrast, in the toner according to the present embodiment, the amount of the group 5 element in the periodic table is no greater than 0.60% by mass. Thus, an upper limit is set for the amount of the group 5 element in the periodic table so that the electric resistance of the specific titanate compound particles contained in the toner according to the present embodiment is not excessively lowered. Therefore, with use of the toner of the present embodiment, occurrence of fogging can be inhibited.

In the present embodiment, in order to form a higher-quality image after printing on a large number of sheets, the amount of the group 5 element in the periodic table is preferably at least 0.10% by mass.

In the present embodiment, in order to form a higher-quality image after printing on a large number of sheets, the amount of lanthanum is preferably at least 1.80% by mass. Further, in the present embodiment, in order to form an image while further inhibiting occurrence of black spots after printing on a large number of sheets, the amount of lanthanum is preferably no greater than 15.00% by mass, and more preferably no greater than 12.50% by mass.

In the present embodiment, in order to form a higher-quality image after printing on a large number of sheets, the group 5 element in the periodic table contained in the specific titanate compound particles is preferably at least one element selected from the group consisting of vanadium, niobium, and tantalum, and more preferably niobium.

In the present embodiment, in order to form a higher-quality image after printing on a large number of sheets, the amount of the specific titanate compound particles is preferably at least 0.1 parts by mass relative to 100 parts by mass of the toner mother particles, and more preferably at least 0.5 parts by mass. Further, in the present embodiment, in order to further inhibit occurrence of fogging, the amount of the specific titanate compound particles is preferably no greater than 1.2 parts by mass relative to 100 parts by mass of the toner mother particles, and more preferably no greater than 1.0 part by mass.

In the present embodiment, in order to form a higher-quality image after printing on a large number of sheets, the specific titanate compound particles have a relative dielectric constant of preferably at least 100 and no greater than 1,200, and more preferably at least 150 and no greater than 1,180. The method for measuring the relative dielectric constant is the same method as that described below in association with Examples or a method conforming therewith.

The toner particles contained in the toner according to the present embodiment may be toner particles each not having a shell layer or toner particles each having a shell layer (may be referred to below as capsule toner particles). In the capsule toner particles, the toner mother particles each include a toner core containing a binder resin, and a shell layer covering the surface of the toner core. The shell layer contains a resin. For example, by covering a toner core that melts at low temperature with a shell layer having excellent heat resistance, it is possible to achieve both heat-resistant preservability and low-temperature fixability of the toner. The resin constituting the shell layer may contain an additive dispersed therein. The shell layer may cover the entire surface of the toner core, or partially cover the surface of the toner core.

The toner mother particles in the present embodiment may further contain an internal additive (for example, at least one of a colorant, a releasing agent, a charge control agent, and a magnetic powder) as necessary in addition to the binder resin.

The following describes the toner according to the present embodiment in detail with reference to the accompanying drawing. The drawing schematically illustrates elements of configuration in order to facilitate understanding. Properties such as size and shape and the number of the elements of configuration illustrated in the drawing may differ from actual properties and the number thereof in order to facilitate preparation of the drawing.

[Structure of Toner Particles]

The following describes a structure of the toner particles included in the toner according to the present embodiment with reference to the drawing. FIGURE is a diagram illustrating an example of a sectional structure of a toner particle included in the toner according to the present embodiment.

A toner particle 10 illustrated in FIGURE includes a toner mother particle 11 containing a binder resin and an external additive attached to the surface of the toner mother particle 11. The external additive includes specific titanate compound particles 12 as external additive particles. The amount of lanthanum contained in the specific titanate compound particles 12 is at least 1.50% by mass relative to the total mass of the specific titanate compound particles 12. The amount of the group 5 element in the periodic table contained in the specific titanate compound particles 12 is preferably at least 0.01% by mass and no greater than 0.60% by mass relative to the total mass of the specific titanate compound particles 12.

In order to obtain a toner suitable for image formation, the volume median diameter ($D_{50}$) of the toner mother particles 11 is preferably at least 4 μm and no greater than 9 μm.

In order to form an image while further inhibiting production of streaks after printing on a large number of sheets, the number average roundness of the specific titanate compound particles 12 is preferably at least 0.79 and no greater than 1.00, and more preferably at least 0.84 and no greater than 1.00. Further, in order to form an image while further inhibiting production of black spots after printing on a large number of sheets, the number average roundness of the specific titanate compound particles 12 is preferably no greater than 0.92. The method for measuring the number average roundness is the same method as that described below in association with Examples or a method conforming therewith.

In order to form a higher-quality image after printing on a large number of sheets, the number average primary particle diameter of the specific titanate compound particles 12 is preferably at least 20 nm and no greater than 80 nm, and more preferably at least 20 nm and no greater than 40 nm.

An example of the structure of the toner particles included in the toner according to the present embodiment has been described so far with reference to FIGURE.

[Elements of Toner Particles]

The following describes elements of the toner particles included in the toner according to the present embodiment.

(Binder Resin)

The binder resin occupies for example at least 70% by mass of all components of the toner mother particles. Accordingly, properties of the binder resin are thought to have a great influence on overall properties of the toner mother particles. In order to impart excellent low-temperature fixability to the toner, the toner mother particles preferably contain a thermoplastic resin as the binder resin, and more preferably contain a thermoplastic resin in an amount of at least 85% by mass relative to the entire binder resin. Examples of thermoplastic resins include styrene-based resins, acrylic acid ester-based resins, olefin-based resins (specific examples include polyethylene resin and polypropylene resin), vinyl resins (specific examples include vinyl chloride resin, polyvinyl alcohol, vinyl ether resin, and N-vinyl resin), polyester resins, polyamide resins, and urethane resins. A copolymer of any of the above-listed resins, that is, a copolymer formed through introduction of a repeating unit into any of the above-listed resins (specific examples include styrene-acrylic acid ester-based resin and styrene-butadiene-based resin) can also be used as the binder resin.

A thermoplastic resin can be obtained through addition polymerization, copolymerization, or condensation polymerization of at least one thermoplastic monomer. Note that a thermoplastic monomer is a monomer that forms a thermoplastic resin through homopolymerization (specific examples include acrylic acid ester-based monomers and styrene-based monomers) or a monomer that forms a thermoplastic resin through condensation polymerization (for example, a combination of a polyhydric alcohol and a polybasic carboxylic acid that form a polyester resin through condensation polymerization).

In order to impart excellent low-temperature fixability to the toner, the toner mother particles preferably contain a polyester resin as the binder resin, and more preferably contain a polyester resin in an amount of at least 80% by mass and no greater than 100% by mass relative to the entire binder resin. A polyester resin can be obtained through condensation polymerization of at least one polyhydric alcohol and at least one polybasic carboxylic acid. Examples of polyhydric alcohols that can be used for synthesis of a polyester resin include dihydric alcohols (specific examples include aliphatic diols and bisphenols) and tri- or higher-hydric alcohols listed below. Examples of polybasic carboxylic acids that can be used for synthesis of a polyester resin include dibasic carboxylic acids and tri- or higher-basic carboxylic acids listed below. Note that a polybasic carboxylic acid derivative (specific examples include an anhydride of a polybasic carboxylic acid and a halide of a polybasic carboxylic acid) that can form an ester bond through condensation polymerization may be used instead of a polybasic carboxylic acid.

Examples of preferable aliphatic diols include diethylene glycol, triethylene glycol, neopentyl glycol, 1,2-propanediol, α,ω-alkanediols (specific examples include ethylene glycol, 1,3-propanediol, 1,4-butanediol, 1,5-pentanediol, 1,6-hexanediol, 1,7-heptanediol, 1,8-octanediol, 1,9-nonanediol, and 1,12-dodecanediol), 2-butene-1,4-diol, 1,4-cyclohexanedimethanol, dipropylene glycol, polyethylene glycol, polypropylene glycol, and polytetramethylene glycol.

Examples of preferable bisphenols include bisphenol A, hydrogenated bisphenol A, bisphenol A ethylene oxide adduct, and bisphenol A propylene oxide adduct.

Examples of preferable tri- or higher-hydric alcohols include sorbitol, 1,2,3,6-hexanetetraol, 1,4-sorbitan, pentaerythritol, dipentaerythritol, tripentaerythritol, 1,2,4-butanetriol, 1,2,5-pentanetriol, glycerol, diglycerol, 2-methylpropanetriol, 2-methyl-1,2,4-butanetriol, trimethylolethane, trimethylolpropane, and 1,3,5-trihydroxymethylbenzene.

Examples of preferable dibasic carboxylic acids include maleic acid, fumaric acid, citraconic acid, itaconic acid, glutaconic acid, phthalic acid, isophthalic acid, terephthalic acid, cyclohexanedicarboxylic acid, adipic acid, sebacic acid, azelaic acid, malonic acid, 1,10-decanedicarboxylic acid, succinic acid, alkyl succinic acids (specific examples include n-butylsuccinic acid, isobutylsuccinic acid, n-octylsuccinic acid, n-dodecylsuccinic acid, and isododecylsuccinic acid), and alkenyl succinic acids (specific examples include n-butenylsuccinic acid, isobutenylsuccinic acid, n-octenylsuccinic acid, n-dodecenylsuccinic acid, and isododecenylsuccinic acid).

Examples of preferable tri- or higher-basic carboxylic acids include 1,2,4-benzenetricarboxylic acid (trimellitic acid), 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, and Empol trimer acid.

(Colorant)

The toner mother particles may contain a colorant. A known pigment or dye that matches the color of the toner can be used as the colorant. In order to form high-quality images with the toner, the amount of the colorant is preferably at least 1 part by mass and no greater than 20 parts by mass relative to 100 parts by mass of the binder resin.

The toner mother particles may contain a black colorant. Carbon black can for example be used as the black colorant. Alternatively, a colorant adjusted to black color using a yellow colorant, a magenta colorant, and a cyan colorant may be used as a black colorant.

The toner mother particles may contain a non-black colorant. Examples of non-black colorants include yellow colorants, magenta colorants, and cyan colorants.

At least one compound selected from the group consisting of condensed azo compounds, isoindolinone compounds, anthraquinone compounds, azo metal complexes, methine compounds, and arylamide compounds can for example be used as the yellow colorant. Examples of yellow colorants include C.I. Pigment Yellow (3, 12, 13, 14, 15, 17, 62, 74, 83, 93, 94, 95, 97, 109, 110, 111, 120, 127, 128, 129, 147, 151, 154, 155, 168, 174, 175, 176, 180, 181, 191, or 194), Naphthol Yellow S, Hansa Yellow G, and C.I. Vat Yellow.

At least one compound selected from the group consisting of condensed azo compounds, diketopyrrolopyrrole compounds, anthraquinone compounds, quinacridone compounds, basic dye lake compounds, naphthol compounds, benzimidazolone compounds, thioindigo compounds, and perylene compounds can for example be used as the magenta colorant. Examples of magenta colorants include C.I. Pigment Red (2, 3, 5, 6, 7, 19, 23, 48:2, 48:3, 48:4, 57:1, 81:1, 122, 144, 146, 150, 166, 169, 177, 184, 185, 202, 206, 220, 221, or 254).

At least one compound selected from the group consisting of copper phthalocyanine compounds, anthraquinone compounds, and basic dye lake compounds can for example be used as the cyan colorant. Examples of cyan colorants include C.I. Pigment Blue (1, 7, 15, 15:1, 15:2, 15:3, 15:4, 60, 62, or 66), Phthalocyanine Blue, C.I. Vat Blue, and C.I. Acid Blue.

(Releasing Agent)

The toner mother particles may contain a releasing agent. The releasing agent may be used in order to impart for example excellent offset resistance to the toner. The amount of the releasing agent is preferably at least 1 part by mass and no greater than 20 parts by mass relative to 100 parts by mass of the binder resin in order to impart excellent offset resistance to the toner.

Examples of releasing agents include ester waxes, polyolefin waxes (specific examples include polyethylene wax and polypropylene wax), microcrystalline wax, fluororesin wax, Fischer-Tropsch wax, paraffin wax, candelilla wax, montan wax, and castor wax. Examples of ester waxes include natural ester waxes (specific examples include carnauba wax and rice wax), and synthetic ester waxes. In the present embodiment, one releasing agent may be used independently or two or more releasing agents may be used in combination.

A compatibilizer may be added to the toner mother particles in order to improve compatibility between the binder resin and the releasing agent.

(Charge Control Agent)

The toner mother particles may contain a charge control agent. The charge control agent is used in order to impart for example excellent charge stability or a charge rise characteristic to the toner. The charge rise characteristic of a toner is an indicator as to whether or not the toner is chargeable to a specific charge level in a short period of time.

As a result of the toner mother particles containing a positively chargeable charge control agent, cationic strength (positive chargeability) of the toner mother particles can be increased. As a result of the toner mother particles containing a negatively chargeable charge control agent by contrast, anionic strength (negative chargeability) of the toner mother particles can be increased.

Examples of positively chargeable charge control agents include: azine compounds such as pyridazine, pyrimidine, pyrazine, 1,2-oxazine, 1,3-oxazine, 1,4-oxazine, 1,2-thiazine, 1,3-thiazine, 1,4-thiazine, 1,2,3-triazine, 1,2,4-triazine, 1,3,5-triazine, 1,2,4-oxadiazine, 1,3,4-oxadiazine, 1,2,6-oxadiazine, 1,3,4-thiadiazine, 1,3,5-thiadiazine, 1,2,3,4-tetrazine, 1,2,4,5-tetrazine, 1,2,3,5-tetrazine, 1,2,4,6-oxatriazine, 1,3,4,5-oxatriazine, phthalazine, quinazoline, and quinoxaline; direct dyes such as Azine Fast Red FC, Azine Fast Red 12BK, Azine Violet BO, Azine Brown 3G, Azine Light Brown GR, Azine Dark Green BH/C, Azine Deep Black EW, and Azine Deep Black 3RL; acid dyes such as Nigrosine BK, Nigrosine NB, and Nigrosine Z; alkoxylated amine; alkylamide; quaternary ammonium salts such as benzyldecylhexylmethyl ammonium chloride, decyltrimethyl ammonium chloride, 2-(methacryloyloxy)ethyl trimethylammonium chloride, and dimethylaminopropyl acrylamide methyl chloride quaternary salt; and a resin having a quaternary ammonium cation group. One of the charge control agents listed above may be used independently, or two or more charge control agents listed above may be used in combination.

Examples of negatively chargeable charge control agents include organic metal complexes, which are chelate compounds. A preferable organic metal complex is at least one selected from the group consisting of metal acetylacetonate complexes, salicylic acid-based metal complexes, and salts of them.

In order to impart excellent charge stability to the toner, the amount of the charge control agent is preferably at least 0.1 parts by mass and no greater than 20 parts by mass relative to 100 parts by mass of the binder resin.

(Magnetic Powder)

The toner mother particles may contain a magnetic powder. Examples of materials of the magnetic powder include ferromagnetic metals (specific examples include iron, cobalt, and nickel), alloys of ferromagnetic metals, ferromagnetic metal oxides (specific examples include ferrite, magnetite, and chromium dioxide), and materials subjected to ferromagnetization (specific examples include carbon materials rendered ferromagnetic through thermal treatment). In the present embodiment, one magnetic powder may be used independently or two or more magnetic powders may be used in combination.

(External Additive)

The toner particles included in the toner according to the present embodiment include an external additive attached to the surfaces of the toner mother particles. The external additive includes one or more types of the specific titanate compound particles as external additive particles.

Examples of the substrate of the specific titanate compound particles (titanate compound to be doped) include titanate compounds having a composition represented by $MTiO_3$ (M is a metal element other than titanium, lanthanum, and group 5 elements in the periodic table). Specific examples of the titanate compound having a composition represented by $MTiO_3$ include strontium titanate ($SrTiO_3$), barium titanate ($BaTiO_3$), calcium titanate ($CaTiO_3$), magnesium titanate ($MgTiO_3$), and lead titanate ($PbTiO_3$). The crystal structure of the titanate compound having a composition represented by $MTiO_3$ is usually a perovskite crystal structure.

When a titanate compound having a composition represented by $MTiO_3$ is used as the substrate of the specific titanate compound particles, lanthanum and the group 5 element in the periodic table are taken into the crystal structure of the substrate by, for example, substitution at a site where the metal represented by M is arranged. A site where the metal represented by M is arranged is referred to below as an M site. Note that specific titanate compound particles obtained by substitution at M sites with lanthanum and the group 5 element in the periodic table will be referred to below as M-site-substituted titanate compound particles.

Peak positions of a powder X-ray diffraction pattern of the M-site-substituted titanate compound particles coincide with peak positions of a powder X-ray diffraction pattern of the crystal structure of the substrate thereof (titanate compound having a composition represented by $MTiO_3$). As such, when peak positions of a powder X-ray diffraction pattern of the specific titanate compound particles coincide with peak positions of a powder X-ray diffraction pattern of the crystal structure of the substrate thereof (titanate compound having a composition represented by $MTiO_3$), it can be determined that the substrate is doped with lanthanum and the group 5 element in the periodic table. "Peak positions coincide" for powder X-ray diffraction patterns means that values of diffraction angle ($2\theta$) of two peak positions compared with each other coincide within a range of $\pm 0.5$ degrees.

In order to form a higher-quality image after printing on a large number of sheets, the specific titanate compound particles are preferably strontium titanate particles doped with lanthanum and a group 5 element in the periodic table, barium titanate particles doped with lanthanum and a group 5 element in the periodic table, or calcium titanate particles doped with lanthanum and a group 5 element in the periodic table, and more preferably strontium titanate particles doped with lanthanum and niobium, barium titanate particles doped with lanthanum and niobium, or calcium titanate particles doped with lanthanum and niobium.

No particular limitations are placed on a method for producing the specific titanate compound particles. In the toner according to the present embodiment, commercially available specific titanate compound particles may be used.

The following describes an example of the method for producing the specific titanate compound particles. First, a mineral acid-peptized product of a titanium source (may be referred to below as a titanium source peptized product), a compound of a metal element other than titanium constituting a substrate (more specifically, strontium, barium, calcium, or the like), a lanthanum source, and a source of a group 5 element in the periodic table are mixed. Next, while the mixture is heated to a temperature of 50° C. or higher, an alkaline aqueous solution is added thereto. The mixture to which the alkaline aqueous solution has been added is kept at a temperature of 50° C. or higher for a specified time (for example, 30 minutes to 2 hours). The resultant product is cooled, and then hydrochloric acid is added thereto to give a precipitate. The precipitate is washed and filtered (solid-liquid separation), and the obtained solid is dried to give a powder of the specific titanate compound particles.

The amount of lanthanum can be adjusted by, for example, changing the amount of the lanthanum source relative to the mass of the titanium source peptized product in the above-described example of the method for producing the specific titanate compound particles. The amount of the group 5 element in the periodic table can be adjusted by, for example, changing the amount of the group 5 element in the periodic table relative to the mass of the titanium source peptized product in the above-described example of the method for producing the specific titanate compound particles. The number average roundness of the specific titanate compound particles can be adjusted by, for example, changing the amount of the lanthanum source relative to the mass of the titanium source peptized product in the above-described example of the method for producing the specific titanate compound particles. The number average primary particle diameter of the specific titanate compound particles can be adjusted by, for example, changing at least one of the mixing ratio of the compound of the metal element other than titanium constituting the substrate to the titanium source peptized product, the alkali concentration of the alkaline aqueous solution, and the amount of the alkaline aqueous solution. The relative dielectric constant of the specific titanate compound particles can be adjusted by, for example, changing at least one of the type of the metal element other than titanium constituting the substrate, the type of the group 5 element in the periodic table, the amount of the group 5 element in the periodic table relative to the mass of the titanium source peptized product, and the amount of the lanthanum source relative to the mass of the titanium source peptized product.

In order to further inhibit occurrence of fogging in a high-temperature and high-humidity environment, the surfaces of the specific titanate compound particles are preferably hidrophobized. Example of a method for obtaining specific titanate compound particles of which surfaces are hidrophobized include a method in which particles constituted by a titanate compound doped with lanthanum and a group 5 element in the periodic table (may be referred to below as a base) are treated with a hydrophobizing agent. The hydrophobizing agent is preferably at least one selected from the group consisting of a silicone oil, a silazane compound, and a silane compound, more preferably a silane compound, further more preferably a silane compound having an alkoxy group and an alkyl group having a carbon number of at least 3 and no greater than 8 (more specific examples include n-propyltrimethoxysilane, n-propyltriethoxysilane, isobutyltrimethoxysilane, n-octyltrimethoxysilane, and n-octyltriethoxysilane), and particularly preferably isobutyltrimethoxysilane.

When the surface of the base is treated with a silane compound having an alkoxy group and an alkyl group having a carbon number of at least 3 and no greater than 8, a dehydration reaction occurs between a hydroxyl group present on the surface of the base and a hydroxyl group generated by hydrolysis of the alkoxy group included in the silane compound due to the presence of moisture. By such a reaction, at least some of hydroxyl groups present on the surface of the base are replaced with functional groups each having an alkyl group derived from the silane compound (specifically, the alkyl group having a carbon number of at least 3 and no greater than 8). That is, by the above reaction, alkyl groups having a carbon number of at least 3 and no greater than 8 (hydrophobic groups) are provided on the surface of the base. Therefore, the surfaces of the specific titanate compound particles hidrophobized with the silane compound having an alkoxy group and an alkyl group having a carbon number of at least 3 and no greater than 8 each have alkyl groups having a carbon number of at least 3 and no greater than 8.

The specific titanate compound particles having alkyl groups having a carbon number of at least 3 and no greater than 8 on the surfaces thereof have relatively high hydrophobicity, thereby being capable of further inhibiting occurrence of fogging.

Examples of a method for hydrophobizing the base include a method in which a hydrophobizing agent is dripped onto or sprayed toward the base with stirring and then the base coated with the hydrophobizing agent is heated, and a method in which the base is added to a solution of a hydrophobizing agent and then the base coated with the hydrophobizing agent is heated. The hydrophobizing agent may be dissolved in an organic solvent. Furthermore, a commercially available hydrophobizing agent diluted with an organic solvent may be used.

In order to form a further higher-quality image even after printing on a large number of sheets while further inhibiting occurrence of fogging, the specific titanate compound particles are preferably strontium titanate particles being doped with lanthanum and a group 5 element in the periodic table and having alkyl groups having a carbon number of at least 3 and no greater than 8 on the surfaces thereof, more preferably strontium titanate particles being doped with lanthanum and niobium and having alkyl groups having a carbon number of at least 3 and no greater than 8 on the surfaces thereof, and further more preferably strontium titanate particles being doped with lanthanum and niobium and having isobutyl groups on the surfaces thereof.

The external additive may contain only the specific titanate compound particles as external additive particles, or further contain additional external additive particles in addition to the specific titanate compound particles. In order to favorably maintain fluidity of the toner, inorganic particles other than the specific titanate compound particles are preferable as the additional external additive particles, and at least one type selected from the group consisting of silica particles and titanium oxide particles are more preferable.

The additional external additive particles may have been subjected to surface treatment. For example, when silica particles are used as the additional external additive particles, surfaces of the silica particles may have hydrophobicity and/or positive chargeability imparted by a surface treatment agent. Examples of the surface treatment agent include coupling agents (specific examples include silane coupling agents, titanate coupling agents, and aluminate coupling agents), silazane compounds (specific examples include chain silazane compounds and cyclic silazane compounds), and silicone oils (specific examples include dimethyl silicone oil). The surface treatment agent is particularly preferably at least one selected from the group consisting of silane coupling agents and silazane compounds. Preferable examples of silane coupling agents include silane compounds (specific examples include methyltrimethoxysilane and aminosilane). Preferable examples of silazane compounds include hexamethyldisilazane (HMDS). When a surface of a silica base (an untreated silica particle) is treated with a surface treatment agent, part or all of a number of hydroxyl groups (—OH) present on the surface of the silica base are replaced with functional groups derived from the surface treatment agent. As a result, obtained silica particles have functional groups derived from the surface treatment agent (specifically, functional groups having higher hydrophobicity and/or higher positive chargeability than hydroxyl groups) on the surfaces thereof.

The amount of the external additive (in a case where an additional external additive is used, the total amount of the specific titanate compound particles and the additional external additive) is preferably at least 0.1 parts by mass and no greater than 10.0 parts by mass relative to 100 parts by mass of the toner mother particles in order to allow the external additive to sufficiently exert its function while inhibiting separation of the external additive from the toner mother particles.

<Toner Production Method>

The following describes a suitable method for producing the toner according to the above-described embodiment. Description of elements overlapping with description of those of the toner according to the embodiment described above is omitted.

[Preparation Process of Toner Mother Particles]

First, toner mother particles are prepared by an aggregation method or a pulverization method.

The aggregation method includes an aggregation step and a coalescence step, for example. The aggregation step involves causing fine particles containing components constituting the toner mother particles to aggregate in an aqueous medium to form aggregated particles. The coalescence step involves causing the components included in the aggregated particles to coalesce in the aqueous medium to form toner mother particles.

The following describes the pulverization method. The pulverization method can relatively easily prepare the toner mother particles and reduce manufacturing cost. In a case where the toner mother particles are prepared by the pulverization method, the toner mother particle preparation process includes for example a melt-kneading step and a pulverization step. The toner mother particle preparation process may further include a mixing step before the melt-kneading step. The toner mother particle preparation process may further include, after the pulverization step, at least one of a fine pulverization step and a classification step.

The mixing step involves mixing the binder resin and an internal additive to be added depending on necessity thereof to yield a mixture. In the melt-kneading step, toner materials are melt-kneaded to yield a melt-kneaded product. The toner materials used in the melt-kneading step are the mixture yielded in the mixing step, for example. In the pulverization step, the resultant melt-kneaded product is cooled for example to room temperature (25° C.) and then pulverized to yield a pulverized product. In a case where reduction in diameter of the pulverized product as a result of performance of the pulverization step is needed, a step of further pulverizing the pulverized product (fine pulverization step) may be performed. Furthermore, in order to equalize the particle diameter of the pulverized product, a step of classifying the resultant pulverized product (classification step) may be performed. Through the above steps, the toner mother particles that are the pulverized product are obtained.

[External Addition Process]

Thereafter, the resultant toner mother particles and an external additive are mixed together using a mixer to attach the external additive to the surfaces of the toner mother particles. The external additive contains at least the specific titanate compound particles. Examples of the mixer include an FM mixer (product of Nippon Coke & Engineering Co., Ltd.). Through the above, a toner containing toner particles is produced.

Examples

The following describes examples of the present disclosure. However, the present disclosure is not limited to the scope of the examples.

<Evaluation Method for Titanate Compound Particles (Evaluation Apparatus)>

First, a method for evaluating titanate compound particles (evaluation apparatus) will be described. Amounts of elements in the titanate compound particles were measured using an ICP spectrometer ("SPS1200VR", product of Seiko Instruments Inc.). Powder X-ray diffraction patterns of the titanate compound particles were measured using an X-ray diffractometer ("RINT (registered Japanese trademark)-TTR III", product of Rigaku Corporation, characteristic X-ray: Cu-Kα ray).

The relative dielectric constant and the number average roundness of the titanate compound particles were measured by respective methods described below.

[Measurement Method of Relative Dielectric Constant]

Any type of the titanate compound particles in an amount of 1 g were compressed under a pressure of 200 kg/cm$^2$ for 2 minutes to be formed into a disc-shaped pellet (measurement sample) having a diameter of 25 mm and a thickness of 1 mm. Next, the above measurement sample was set in a rotary rheometer ("ARES-G2", product of TA Instruments) equipped with a dielectric constant measuring jig (electrode) having a diameter of 25 mm. Using an LCR meter ("4284A Precision LCR Meter", product of Keysight Technologies, Inc.), a D of the measurement sample (titanate compound particles) was obtained under conditions of a measurement temperature of 25° C., a load of 150 g, an applied voltage of 1.0 V, and a frequency of 1.0 MHz.

[Measurement Method of Number Average Roundness]

A powder of the titanate compound particles was photographed by a scanning electron microscope ("JSM-7401F", product of JEOL Ltd.), and an obtained image was analyzed using image analysis software ("WinROOF", product of Mitani Corporation). Specifically, 100 particles were randomly selected from the titanate compound particles present in the image, and roundness of each of the 100 particles (perimeter of a circle having an area equal to the projected area of the particle/perimeter of the particle) was determined. A number average value was calculated from the measured roundness values of the 100 particles, and the obtained value was taken to be a number average roundness of the titanate compound particles.

<Preparation of Titanate Compound Particles>

The following describes a method for preparing titanate compound particles EA-1 to EA-4 and EB-1 to EB-5.

[Preparation of Titanate Compound Particles EA-1]

(Reaction Preparation Step)

First, a reaction preparation step will be described. Metatitanic acid obtained by the sulfuric acid method was subjected to a deironization treatment. To this, an aqueous solution of sodium hydroxide was added to prepare a suspension at a pH of 9.0. After the resulting suspension was desulfurized, hydrochloric acid was added thereto to adjust the pH of the suspension to 5.8. Subsequently, the suspension adjusted to pH 5.8 was filtered (solid-liquid separation), and the resultant solid was washed with water. Ion exchanged water was added to the water-washed solid to give a slurry having a Ti concentration of 2.13 mol/L. A peptization treatment was performed by adding hydrochloric acid to the slurry. The pH of the slurry after the peptization treatment was 1.4. The peptized slurry (1.8770 mol in terms of $TiO_2$) was added into a 3-L reaction vessel. Next, an aqueous solution of strontium chloride ($SrCl_2$) in an amount of 2.1590 mol in terms of Sr was added into the reaction vessel. The contents of the reaction vessel after the addition of the strontium chloride aqueous solution (the contents of the reaction vessel will be referred to below as simply "vessel contents") had a molar ratio of Sr to Ti (Sr/Ti) of 1.15. Next, an aqueous solution of lanthanum chloride ($LaCl_3$) in an amount of 0.2160 mol in terms of La was added into the reaction vessel. The vessel contents after the addition of the lanthanum chloride aqueous solution had a molar ratio of La to Sr (La/Sr) of 0.10. Next, niobium pentoxide ($Nb_2O_5$) in an amount of 0.0188 mol in terms of Nb was added into the reaction vessel. The vessel contents after the addition of the niobium pentoxide had a molar ratio of Nb to Ti (Nb/Ti) of 0.01. Subsequently, ion exchanged water was added to the vessel contents to give a slurry having a Ti concentration of 0.939 mol/L.

(Reaction Step)

Next, a reaction step will be described. While the slurry obtained through the above-described procedure (Ti concentration: 0.939 mol/L) was stirred, the internal temperature of the reaction vessel was raised to 90° C., and then 553 mL of an aqueous solution of sodium hydroxide (NaOH concentration: 10 mol/L) was added at a constant rate over 1 hour. Next, the internal temperature of the reaction vessel was raised to 95° C., and the vessel contents were stirred for 1 hour while the internal temperature of the reaction vessel was kept at 95° C. Subsequently, the vessel contents were cooled to 50° C., and hydrochloric acid was added thereto to adjust the pH of the vessel contents to 5.0. Next, the vessel contents were stirred for 1 hour while the internal temperature of the reaction vessel was kept at 50° C. to give a precipitate.

The resulting precipitate was washed by repetition of decantation and dispersion in ion exchanged water. After filtration (solid-liquid separation), the obtained solid was dried in an atmosphere at a temperature of 120° C. for 10 hours to give a powder of titanate compound particles A-1 containing lanthanum and niobium.

(Hydrophobization Step)

Next, a hydrophobization step will be described. A three-necked flask equipped with a thermometer and a stirrer was charged with 100 parts by mass of the titanate compound particles A-1, and air in the flask was substituted with nitrogen to establish a nitrogen atmosphere inside the flask. Subsequently, while stirring the flask contents, 15 parts by mass of isobutyltrimethoxysilane and distilled water in an amount suitable for allowing a reaction (specifically, hydrolysis reaction) on the surfaces of the titanate compound particles A-1 to proceed were sprayed into the flask. Thereafter, while stirring the contents of the flask, the titanate compound particles A-1 and isobutyltrimethoxysilane were reacted at a temperature of 110° C. for 2 hours. As a result, a powder of the titanate compound particles EA-1 that contained the titanate compound particles A-1 (substrate) and isobutyl groups (specifically, isobutyl groups from isobutyltrimethoxysilane) provided on the surfaces of the titanate compound particles A-1 was obtained.

(Number Average Primary Particle Diameter, Number Average Roundness, and Powder X-Ray Diffraction Pattern)

The obtained titanate compound particles EA-1 had a number average primary particle diameter of 30 nm. Furthermore, the obtained titanate compound particles EA-1 had a number average roundness of 0.84. Further, the peak positions of a powder X-ray diffraction pattern of the obtained titanate compound particles EA-1 coincided with the peak positions of the powder X-ray diffraction pattern of the perovskite crystal structure of strontium titanate (substrate). That is, the titanate compound particles EA-1 were strontium titanate particles doped with lanthanum and niobium. Note that the titanate compound particles EA-1 did not contain any group 5 elements in the periodic table other than niobium. Note that the same results as above were obtained when the number average primary particle diameter, the number average roundness, and the powder X-ray diffraction pattern of a powder of the titanate compound particles EA-1 as a measurement target that have been separated from toner particles of a toner produced by a method described below were measured. The same applies to the number average primary particle diameter, the number average roundness, and the powder X-ray diffraction pattern of each type of titanate compound particles EA-2 to EA-4 and EB-1 to EB-5 described below.

[Preparation of Titanate Compound Particles EA-2]

A powder of titanate compound particles EA-2 was produced by the same method as that for preparation of the titanate compound particles EA-1 in all aspects other than that the amount used (amount added) of the aqueous solution of lanthanum chloride was changed to 0.4320 mol in terms of La and vanadium pentoxide (composition formula: $V_2O_5$, amount added: 0.0563 mol in terms of V) was used instead of niobium pentoxide (0.0188 mol in terms of Nb), in the reaction preparation step. The titanate compound particles EA-2 were titanate compound particles having titanate compound particles A-2 (base) containing lanthanum and vanadium, and isobutyl groups provided on the surfaces of the titanate compound particles A-2. The obtained titanate compound particles EA-2 had a number average primary particle diameter of 30 nm. Furthermore, the obtained titanate compound particles EA-2 had a number average roundness of 0.92. Further, the peak positions of the powder X-ray diffraction pattern of the obtained titanate compound particles EA-2 coincided with the peak positions of the powder X-ray diffraction pattern of the perovskite crystal structure of strontium titanate (substrate). That is, the titanate compound particles EA-2 were strontium titanate particles doped with lanthanum and vanadium. Note that the titanate compound particles EA-2 did not contain any group 5 elements in the periodic table other than vanadium.

[Preparation of Titanate Compound Particles EA-3]

A powder of titanate compound particles EA-3 was produced by the same method as that for preparation of the titanate compound particles EA-1 in all aspects other than that an aqueous solution of barium chloride ($BaCl_2$) (2.1590 mol in terms of Ba) was used instead of the aqueous solution of strontium chloride (2.1590 mol in terms of Sr), the amount used (amount added) of the aqueous solution of lanthanum chloride was changed to 0.0650 mol in terms of La, and tantalum pentoxide (composition formula: $Ta_2O_5$, amount added: 0.0019 mol in terms of Ta) was used instead of niobium pentoxide (0.0188 mol in terms of Nb), in the reaction preparation step. The titanate compound particles EA-3 were titanate compound particles having titanate compound particles A-3 (base) containing lanthanum and tantalum, and isobutyl groups provided on the surfaces of the titanate compound particles A-3. The obtained titanate compound particles EA-3 had a number average primary particle diameter of 30 nm. Furthermore, the obtained titanate compound particles EA-3 had a number average roundness of 0.79. Further, the peak positions of the powder X-ray diffraction pattern of the obtained titanate compound particles EA-3 coincided with the peak positions of the powder X-ray diffraction pattern of the perovskite crystal structure of barium titanate (substrate). That is, the titanate compound particles EA-3 were barium titanate particles doped with lanthanum and tantalum. Note that the titanate compound particles EA-3 did not contain any group 5 elements in the periodic table other than tantalum.

[Preparation of Titanate Compound Particles EA-4]

A powder of titanate compound particles EA-4 was produced by the same method as that for preparation of the titanate compound particles EA-1 in all aspects other than that an aqueous solution of calcium chloride ($CaCl_2$) (2.1590 mol in terms of Ca) was used instead of the aqueous solution of strontium chloride (2.1590 mol in terms of Sr), in the reaction preparation step. The titanate compound particles EA-4 were titanate compound particles having titanate compound particles A-4 (base) containing lanthanum and niobium, and isobutyl groups provided on the surfaces of the titanate compound particles A-4. The obtained titanate compound particles EA-4 had a number average primary particle diameter of 30 nm. Furthermore, the obtained titanate compound particles EA-4 had a number average roundness of 0.84. Further, the peak positions of the powder X-ray diffraction pattern of the obtained titanate compound particles EA-4 coincided with the peak positions of the powder X-ray diffraction pattern of the perovskite crystal structure of calcium titanate (substrate). That is, the titanate compound particles EA-4 were calcium titanate particles doped with lanthanum and niobium. Note that the titanate compound particles EA-4 did not contain any group 5 elements in the periodic table other than niobium.

[Preparation of Titanate Compound Particles EB-1]

A powder of titanate compound particles EB-1 was produced by the same method as that for preparation of the titanate compound particles EA-1 in all aspects other than that the aqueous solution of lanthanum chloride was not used (added), an aqueous solution of barium chloride ($BaCl_2$) (2.1590 mol in terms of Ba) was used instead of the aqueous solution of strontium chloride (2.1590 mol in terms of Sr), and tantalum pentoxide (0.0653 mol in terms of Ta) was used instead of niobium pentoxide (0.0188 mol in terms of Nb), in the reaction preparation step. The titanate compound particles EB-1 were titanate compound particles having titanate compound particles B-1 (base) containing tantalum, and isobutyl groups provided on the surfaces of the titanate compound particles B-1. The obtained titanate compound particles EB-1 had a number average primary particle diameter of 30 nm. Furthermore, the obtained titanate compound particles EB-1 had a number average roundness of 0.78. Further, the peak positions of the powder X-ray diffraction pattern of the obtained titanate compound particles EB-1 coincided with the peak positions of the powder X-ray diffraction pattern of the perovskite crystal structure of barium titanate (substrate). That is, the titanate compound particles EB-1 were barium titanate particles doped with tantalum. Note that the titanate compound particles EB-1 did not contain any group 5 elements in the periodic table other than tantalum.

[Preparation of Titanate Compound Particles EB-2]

A powder of titanate compound particles EB-2 was produced by the same method as that for preparation of the titanate compound particles EA-1 in all aspects other than that niobium pentoxide was not used (added), an aqueous solution of barium chloride ($BaCl_2$) (2.1590 mol in terms of Ba) was used instead of the aqueous solution of strontium chloride (2.1590 mol in terms of Sr), and the amount used (amount added) of the aqueous solution of lanthanum chloride was changed to 0.0650 mol in terms of La, in the reaction preparation step. The titanate compound particles EB-2 were titanate compound particles having titanate compound particles B-2 (base) containing lanthanum, and isobutyl groups provided on the surfaces of the titanate compound particles B-2. The obtained titanate compound particles EB-2 had a number average primary particle diameter of 30 nm. Furthermore, the obtained titanate compound particles EB-2 had a number average roundness of 0.81. Further, the peak positions of the powder X-ray diffraction pattern of the obtained titanate compound particles EB-2 coincided with the peak positions of the powder X-ray diffraction pattern of the perovskite crystal structure of barium titanate (substrate). That is, the titanate compound particles EB-2 were barium titanate particles doped with lanthanum.

[Preparation of Titanate Compound Particles EB-3]

A powder of titanate compound particles EB-3 was produced by the same method as that for preparation of the titanate compound particles EA-1 in all aspects other than that vanadium pentoxide (0.0657 mol in terms of V) was used instead of niobium pentoxide (0.0188 mol in terms of Nb) in the reaction preparation step. The titanate compound particles EB-3 were titanate compound particles having titanate compound particles B-3 (base) containing lanthanum and vanadium, and isobutyl groups provided on the surfaces of the titanate compound particles B-3. The obtained titanate compound particles EB-3 had a number average primary particle diameter of 30 nm. Furthermore, the obtained titanate compound particles EB-3 had a number average roundness of 0.84. Further, the peak positions of the powder X-ray diffraction pattern of the obtained titanate compound particles EB-3 coincided with the peak positions of the powder X-ray diffraction pattern of the perovskite crystal structure of strontium titanate (substrate). That is, the titanate compound particles EB-3 were strontium titanate particles doped with lanthanum and vanadium. Note that the titanate compound particles EB-3 did not contain any group 5 elements in the periodic table other than vanadium.

[Preparation of Titanate Compound Particles EB-4]

A powder of titanate compound particles EB-4 was produced by the same method as that for preparation of the titanate compound particles EA-1 in all aspects other than that niobium pentoxide was not used (added), the amount used (amount added) of the aqueous solution of strontium chloride was changed to 1.8770 mol in terms of Sr, and the amount used (amount added) of the aqueous solution of lanthanum chloride was changed to 0.3380 mol in terms of La, in the reaction preparation step. The titanate compound particles EB-4 were titanate compound particles having titanate compound particles B-4 (base) containing lanthanum, and isobutyl groups provided on the surfaces of the titanate compound particles B-4. The obtained titanate compound particles EB-4 had a number average primary particle diameter of 30 nm. Furthermore, the obtained titanate compound particles EB-4 had a number average roundness of 0.85. Further, the peak positions of the powder X-ray diffraction pattern of the obtained titanate compound particles EB-4 coincided with the peak positions of the powder X-ray diffraction pattern of the perovskite crystal structure of strontium titanate (substrate). That is, the titanate compound particles EB-4 were strontium titanate particles doped with lanthanum.

[Preparation of Titanate Compound Particles EB-5]

A powder of titanate compound particles EB-5 was produced by the same method as that for preparation of the titanate compound particles EA-1 in all aspects other than that the amount used (amount added) of the aqueous solution of lanthanum chloride was changed to 0.0432 mol in terms of La in the reaction preparation step. The titanate compound particles EB-5 were titanate compound particles having titanate compound particles B-5 (base) containing lanthanum and niobium, and isobutyl groups provided on the surfaces of the titanate compound particles B-5. The obtained titanate compound particles EB-5 had a number average primary particle diameter of 30 nm. Furthermore, the obtained titanate compound particles EB-5 had a number average roundness of 0.84. Further, the peak positions of the powder X-ray diffraction pattern of the obtained titanate compound particles EB-5 coincided with the peak positions of the powder X-ray diffraction pattern of the perovskite crystal structure of strontium titanate (substrate). That is, the titanate compound particles EB-5 were strontium titanate particles doped with lanthanum and niobium. Note that the titanate compound particles EB-5 did not contain any group 5 elements in the periodic table other than niobium.

Table 1 shows the amount of a group 5 element in the periodic table, the amount of lanthanum, and the relative dielectric constant of each type of the titanate compound particles EA-1 to EA-4 and EB-1 to EB-5. In Table 1, the amount of the group 5 element in the periodic table and the amount of lanthanum are each an amount relative to the total mass of a corresponding one type of the titanate compound particles (unit: % by mass). In Table 1, "-" indicates that the resultant value was less than the detectable limit of the ICP spectrometer used for the measurement (0.01 ppm by mass relative to the total mass of the titanate compound particles). Note that the same results as above were obtained when the amount of a group 5 element in the periodic table, the amount of lanthanum, and the relative dielectric constant were measured for a powder of each type titanate compound particles as a measurement target that had been separated from toner particles of a toner produced by a method described below.

TABLE 1

| Titanate compound particles | Amount of group 5 element in periodic table [% by mass] | Amount of lanthanum [% by mass] | Relative dielectric constant |
|---|---|---|---|
| EA-1 | 0.10 | 6.77 | 280 |
| EA-2 | 0.55 | 12.20 | 210 |
| EA-3 | 0.01 | 1.97 | 1180 |
| EA-4 | 0.16 | 8.66 | 150 |
| EB-1 | 0.37 | — | 1200 |
| EB-2 | — | 5.58 | 1150 |
| EB-3 | 0.64 | 6.52 | 280 |
| EB-4 | — | 13.15 | 225 |
| EB-5 | 0.11 | 1.33 | 310 |

<Production of Toner>

The following describes a method for producing toners TA-1 to TA-5 and TB-1 to TB-6.

[Production of Toner TA-1]

(Polyester Resin Synthesis Process)

A reaction vessel was charged with 1.0 mol of a bisphenol A ethylene oxide adduct (average number of moles of ethylene oxide: 2 mol), 4.5 mol of terephthalic acid, 0.5 mol of trimellitic anhydride, and 4.0 g of dibutyltin oxide. Subsequently, the vessel contents were reacted in a nitrogen atmosphere under atmospheric pressure at 230° C. for 8 hours. Thereafter, the pressure in the vessel was reduced to 8.3 kPa, and unreacted components were distilled off under reduced pressure to give a polyester resin (binder resin) having a softening point (Tm) of 120° C.

(Toner Mother Particle Preparation Process)

An FM mixer ("FM-20B", product of Nippon Coke & Engineering Co., Ltd.) was charged with 100 parts by mass of the polyester resin obtained by the above-described synthesis process, 4 parts by mass of a colorant (C.I. Pigment Blue 15:1, product of Sanyo Color Works, Ltd.), 10 parts by mass of a carnauba wax as a releasing agent (Carnauba Wax No. 1, product of S. Kato & CO.), and 3 parts by mass of a positively chargeable charge control agent ("ACRYBASE (registered Japanese trademark) FCA-201PS", product of Fujikura Kasei Co., Ltd.), and the charged materials were mixed using the FM mixer at a rotational speed of 2,000 rpm for 4 minutes.

Subsequently, the resultant mixture was melt-kneaded at a temperature of 150° C. using a twin-screw extruder ("TEM45", product of Toshiba Machine Co., Ltd.). The resulting melt-kneaded product was subsequently cooled. Thereafter, the cooled melt-kneaded product was coarsely pulverized using a pulverizer ("FEATHER MILL (registered Japanese trademark) Model 350×600", product of Hosokawa Micron Corporation). Subsequently, the resultant coarsely pulverized product was finely pulverized using a jet pulverizer ("JET MILL IDS-2", product of Nippon Pneumatic Mfg. Co., Ltd.). Subsequently, the finely pulverized product was classified using a classifier ("ELBOW JET Model EJ-LABO", product of Nittetsu Mining Co., Ltd.). Through the above, toner mother particles having a volume median diameter ($D_{50}$) of 7 μm were obtained.

(External Addition Process)

An FM mixer ("FM-10B", product of Nippon Coke & Engineering Co., Ltd.) was charged with 100 parts by mass of toner mother particles (the toner mother particles obtained through the above-described preparation process), 0.5 parts by mass of the titanate compound particles EA-1, 1.5 parts by mass of hydrophobic silica particles ("AEROSIL (registered Japanese trademark) RA-200H", product of Nippon Aerosil Co., Ltd.), and 1.0 part by mass of conductive titanium oxide particles ("EC-100", product of Titan Kogyo, Ltd.). Subsequently, the toner mother particles and the external additives (the titanate compound particles EA-1, the hydrophobic silica particles, and the conductive titanium oxide particles) were mixed using the FM mixer under conditions of a rotational speed of 3,500 rpm and a jacket temperature of 20° C. for 15 minutes. Through the above, the entire amount of the external additives were attached to the surfaces of the toner mother particles.

Subsequently, the obtained powder was sieved using a 200-mesh sieve (aperture 75 μm). As a result, a positively chargeable toner TA-1 was obtained. Note that the composition ratio of the components constituting the toner TA-1 did not change between before and after the sieving.

[Production of Toners TA-2 to TA-5 and TB-1 to TB-6]

The positively chargeable toners TA-2 to TA-5 and TB-1 to TB-6 were produced by the same method as the production method of the toner TA-1 in all aspects except that the types of titanate compound particles and the amounts thereof added were as shown in Table 2 below. Also, the positively chargeable toner TB-1 was prepared by the same method as the production method of the toner TA-1 in all aspects except that the titanate compound particles EA-1 were not used (added). Note that the column "Amount added" in Table 2 lists amounts of respective types of titanate compound particles (unit: parts by mass) added into the FM mixer relative to 100 parts by mass of the toner mother particles. Also, "-" in the column of titanate compound particles in Table 2 means that no titanate compound particles were used.

<Evaluation Method>

The following describes a method for evaluating toners TA-1 to TA-5 and TB-1 to TB-6.

[Preparation of Two-Component Developer]

(Carrier Preparation Process)

Ferrite cores ("EF-35B", product of Powdertech Co., Ltd., volume median diameter ($D_{50}$): 35 μm) were prepared as carrier cores. Further, a solution of a heat-curable silicone resin ("KR-220L", product of Shin-Etsu Chemical Co., Ltd., curing start temperature: 170° C.) at a solid concentration adjusted to 17% by mass with toluene was prepared as a liquid containing a raw material of coating layers for covering the carrier cores (coating liquid). A tumbling fluidized bed coater ("SPIRA COTA (registered Japanese trademark) SP-25", product of Okada Seiko Co., Ltd.) was charged with 1,000 parts by mass of the ferrite cores prepared as above, and 120 parts by mass of the coating liquid prepared as above was sprayed toward the ferrite cores while the ferrite cores were kept flowing. Subsequently, the ferrite cores covered with the coating liquid was heat-treated at a temperature of 200° C. for 2 hours to give a powder (carrier) of carrier particles each including a ferrite core having a surface entirely covered with a coating layer (a layer constituted by the silicone resin).

(Mixing Process of Carrier and Toner)

Using a ball mill, 100 parts by mass of the carrier obtained through the above preparation process and 10 parts by mass of a toner (evaluation target: one of the toners TA-1 to TA-5 and TB-1 to TB-6) were mixed for 30 minutes to prepare a two-component developer for evaluation.

[Determination of Image Defects Caused by Excessive Polishing of Photosensitive Drum Surface]

A color multifunction peripheral ("TASKalfa 3252ci", product of KYOCERA Document Solutions Inc.) was used as an evaluation apparatus. The evaluation apparatus included an organic photosensitive drum (a photosensitive drum including a photosensitive layer containing an organic photoconductor). A two-component developer containing an evaluation target (a two-component developer prepared by the above-descried method) was loaded into a cyan-color development device of the evaluation apparatus, and a toner for replenishment use (evaluation target: one of the toners TA-1 to TA-5 and TB-1 to TB-6) was loaded into the cyan-color toner container.

Next, an image having a printing rate of 5% was consecutively printed on 20,000 sheets of paper (A4 size) using the evaluation apparatus in an environment at a temperature of 23° C. and a relative humidity of 50%. Next, an image having a printing rate of 5% was printed on one sheet of paper (A4 size) in an environment at a temperature of 23° C. and a relative humidity of 50%, and the printed image was visually observed. Determination was made on image defects (streaks) caused by polishing of the surface of a photosensitive drum based on the following criteria. Evaluation determined as "excellent" was rated at A, evaluation determined as "good" was rated at B, and evaluation determined as "poor" was rated at C.

(Determination Criteria)

A: No streaks were observed.

B: A few streaks were observed but practically acceptable.

C: Streaks were observed and practically problematic.

[Evaluation in High-Temperature and High-Humidity Environment]

A color multifunction peripheral ("TASKalfa 3252ci", product of KYOCERA Document Solutions Inc.) was used as an evaluation apparatus. A two-component developer containing an evaluation target (a two-component developer prepared by the above-descried method) and a toner for replenishment use (evaluation target: one of the toners TA-1 to TA-5 and TB-1 to TB-6) were left to stand in an environment at a temperature of 32.5° C. and a relative humidity of 80% for 24 hours. Next, the two-component developer after left standing was loaded into the cyan-color development device of the evaluation apparatus, and the toner for replenishment use after left standing was loaded into the cyan-color toner container of the evaluation apparatus.

Next, an image having a printing rate of 5% was printed on one sheet of paper (A4 size) using the evaluation apparatus in an environment at a temperature of 32.5° C. and a relative humidity of 80%, and thus, an evaluation image A was obtained. Immediately after the evaluation image A was obtained, the two-component developer was taken out of the cyan-color development device of the evaluation apparatus. Next, the charge amount (unit: μC/g) of the toner contained in the taken-out two-component developer was measured using a Q/m meter ("MODEL 210HS-2A", product of Trek, Inc.) in an environment at a temperature of 32.5° C. and a relative humidity of 80%. The charge amount measured here will be referred to below as E1. E1 of at least 15.0 μC/g was evaluated as "good". E1 of less than 15.0 μC/g was evaluated as "poor".

Further, the image density (ID) of the blank portion of the printed evaluation image A was measured using a reflectance densitometer ("SpectroEye (registered Japanese trademark)", product of X-Rite Inc.), and a fogging density (FD) was calculated. The fogging density (FD) corresponds to a value obtained by subtracting the image density (ID) of a base paper (unprinted paper) from the image density (ID) of the blank portion of the evaluation image A.

A fogging density (FD) of no greater than 0.005 was evaluated as "occurrence of fogging was particularly inhibited". A fogging density (FD) of greater than 0.005 and no greater than 0.010 was evaluated as "occurrence of fogging was inhibited". A fogging density (FD) of greater than 0.010 was evaluated as "occurrence of fogging was not inhibited".

[Evaluation in Low-Temperature and Low-Humidity Environment]

(Initial Charge Amount)

A color multifunction peripheral ("TASKalfa 3252ci", product of KYOCERA Document Solutions Inc.) was used as an evaluation apparatus. A two-component developer containing an evaluation target (a two-component developer prepared by the above-descried method) and a toner for replenishment use (evaluation target: one of the toners TA-1 to TA-5 and TB-1 to TB-6) were left to stand in an environment at a temperature of 10° C. and a relative humidity of 10% for 12 hours. Next, the two-component developer after left standing was loaded into the cyan-color development device of the evaluation apparatus, and the toner for replenishment use after left standing was loaded into the cyan-color toner container of the evaluation apparatus.

Next, an image having a printing rate of 2% was printed on one sheet of paper (A4 size) in an environment at a temperature of 10° C. and a relative humidity of 10%, and then, the two-component developer was taken out of the cyan-color development device of the evaluation apparatus. Next, the charge amount (unit: μC/g) of the toner contained in the taken-out two-component developer was measured using a Q/m meter ("MODEL 210HS-2A", product of Trek, Inc.) in an environment at a temperature of 10° C. and a relative humidity of 10%. The charge amount measured here (initial charge amount) will be referred to below as E2. E2 of no greater than 45.0 μC/g was evaluated as "good". E2 of greater than 45.0 μC/g was evaluated as "poor".

(Presence or Absence of Black Spots, Image Density, and Charge Amount after Consecutive Printing)

A color multifunction peripheral ("TASKalfa 3252ci", product of KYOCERA Document Solutions Inc.) was used as an evaluation apparatus. A two-component developer containing an evaluation target (a two-component developer prepared by the above-descried method) and a toner for replenishment use (evaluation target: one of the toners TA-1 to TA-5 and TB-1 to TB-6) were left to stand in an environment at a temperature of 10° C. and a relative humidity of 10% for 12 hours. Next, the two-component developer after left standing was loaded into the cyan-color development device of the evaluation apparatus, and the toner for replenishment use after left standing was loaded into the cyan-color toner container of the evaluation apparatus.

Next, an image having a printing rate of 2% was consecutively printed on 20,000 sheets of paper (A4 size) in an environment at a temperature of 10° C. and a relative humidity of 10%. Next, a pattern image including a solid image was printed on one sheet of paper (A4 size) in an environment at a temperature of 10° C. and a relative humidity of 10%, and thus, an evaluation image B was obtained. Immediately after the evaluation image B was obtained, the two-component developer was taken out of the cyan-color development device of the evaluation apparatus. Next, the charge amount (unit: μC/g) of the toner contained in the taken-out two-component developer was measured using a Q/m meter ("MODEL 210HS-2A", product of Trek, Inc.) in an environment at a temperature of 10° C. and a relative humidity of 10%. The charge amount measured here (charge amount after the consecutive printing) will be referred to below as E3. E3 of no greater than 45.0 μC/g was evaluated as "good". E3 of greater than 45.0 μC/g was evaluated as "poor".

The printed evaluation image B was visually observed for determining the presence or absence of image defects (black spots) caused by dielectric breakdown of the photosensitive drum.

Further, the image density (ID) of a printed portion of the printed evaluation image B was measured using a reflectance densitometer ("SpectroEye (registered Japanese trademark)", product of X-Rite Inc.). An image density (ID) of at least 1.20 was evaluated as "excellent", an image density (ID) of at least 1.00 and less than 1.20 was evaluated as "good", and an image density (ID) of less than 1.00 was evaluated as "poor."

<Evaluation Results>

Table 2 shows the type of titanate compound particles, the amount added of the titanate compound particles, and the determination result of image defects caused by photosensitive drum surface polishing for each of the toners TA-1 to TA-5 and TB-1 to TB-6. Table 3 shows evaluation results in a high-temperature and high-humidity environment and in a low-temperature and low-humidity environment for each of the toners TA-1 to TA-5 and TB-1 to TB-6.

TABLE 2

| | | Titanate compound particles | | Rating of image defects caused by |
|---|---|---|---|---|
| | Toner | Type | Amount added [parts by mass] | photosensitive drum surface polishing |
| Example 1 | TA-1 | EA-1 | 0.5 | A |
| Example 2 | TA-2 | EA-2 | 1.0 | A |
| Example 3 | TA-3 | EA-3 | 0.1 | B |
| Example 4 | TA-4 | EA-1 | 1.2 | A |
| Example 5 | TA-5 | EA-4 | 0.5 | A |
| Comparative Example 1 | TB-1 | — | — | A |
| Comparative Example 2 | TB-2 | EB-1 | 0.5 | C |
| Comparative Example 3 | TB-3 | EB-2 | 0.5 | A |
| Comparative Example 4 | TB-4 | EB-3 | 0.5 | A |
| Comparative Example 5 | TB-5 | EB-4 | 0.5 | A |
| Comparative Example 6 | TB-6 | EB-5 | 0.5 | C |

TABLE 3

| | | Evaluation result in high-temperature and high-humidity environment | | Evaluation result in low-temperature and low-humidity environment | | | |
|---|---|---|---|---|---|---|---|
| | Toner | E1 [μC/g] | FD | E2 [μC/g] | E3 [μC/g] | Presence or absence of black spots | ID |
| Example 1 | TA-1 | 20.6 | 0.003 | 32.2 | 37.1 | Absent | 1.25 |
| Example 2 | TA-2 | 18.3 | 0.005 | 29.3 | 33.4 | Absent | 1.35 |
| Example 3 | TA-3 | 22.7 | 0.000 | 33.7 | 39.8 | Absent | 1.20 |
| Example 4 | TA-4 | 15.1 | 0.009 | 28.6 | 32.8 | Absent | 1.37 |
| Example 5 | TA-5 | 15.0 | 0.009 | 28.3 | 32.5 | Absent | 1.39 |
| Comparative Example 1 | TB-1 | 24.3 | 0.001 | 35.3 | 45.4 | Absent | 0.95 |
| Comparative Example 2 | TB-2 | 21.9 | 0.001 | 32.5 | 36.7 | Absent | 1.29 |
| Comparative Example 3 | TB-3 | 22.5 | 0.000 | 32.3 | 41.8 | Present | 1.05 |
| Comparative Example 4 | TB-4 | 14.5 | 0.011 | 27.8 | 31.7 | Absent | 1.42 |
| Comparative Example 5 | TB-5 | 21.8 | 0.001 | 31.7 | 40.8 | Present | 1.10 |
| Comparative Example 6 | TB-6 | 21.5 | 0.002 | 32.4 | 37.3 | Absent | 1.25 |

As shown in Tables 1 and 2, each external additive of the toners TA-1 to TA-5 contained titanate compound particles doped with lanthanum and a group 5 element in the periodic table as external additive particles. The toners TA-1 to TA-5 each contained lanthanum in an amount of at least 1.50% by mass relative to the total mass of the titanate compound particles. The toners TA-1 to TA-5 each contained a group 5 element in an amount of at least 0.01% by mass and no greater than 0.60% by mass relative to the total mass of the titanate compound particles.

As shown in Table 3, use of any of the toners TA-1 to TA-3 resulted in a fogging density (FD) of no greater than 0.005. Thus, use of any of the toners TA-1 to TA-3 particularly inhibited occurrence of fogging. Use of either of toners TA-4 and TA-5 resulted in a fogging density (FD) of greater than 0.005 and no greater than 0.010. Thus, use of either of the toners TA-4 and TA-5 inhibited the occurrence of fogging.

As shown in Table 2, the toners TA-1 to TA-5 were rated at A (excellent) or B (good) in evaluation of image defects caused by photosensitive drum surface polishing. As shown in Table 3, with use of any of the toners TA-1 to TA-5, image defects (black spots) caused by dielectric breakdown of the photosensitive drum were not observed. Use of any of the toners TA-1 to TA-5 resulted in an image density (ID) of at least 1.20 (excellent). The above evaluation results show that with use of any of the toners TA-1 to TA-5, high-quality image formation can be achieved even after printing on a large number of sheets.

As shown in Tables 1 and 2, the external additive of the toner TB-1 did not contain titanate compound particles. The toners TB-2 and TB-6 each contained lanthanum in an amount of less than 1.50% by mass relative to the total mass of titanate compound particles. The toners TB-3 and TB-5 each contained a group 5 element in the periodic table in an amount of less than 0.01% by mass relative to the total mass of the titanate compound particles. The toner TB-4 contained a group 5 element in the periodic table in an amount of greater than 0.60% by mass relative to the total mass of the titanate compound particles.

As shown in Table 2, the toners TB-2 and TB-6 were rated at C (poor) in evaluation of image defects caused by photosensitive drum surface polishing. As shown in Table 3, use of the toner TB-1 resulted in an image density (ID) of less than 1.00 (poor). With use of either of the toners TB-3 and TB-5, image defects (black spots) caused by dielectric breakdown of the photosensitive drum were observed.

As shown in Table 3, use of the toner TB-4 resulted in a fogging density (FD) of greater than 0.010. Thus, the toner TB-4 did not inhibit occurrence of fogging.

The above results showed that with use of the toner according to the present disclosure, a high-quality image can be formed even after printing on a large number of sheets while inhibiting occurrence of fogging.

What is claimed is:

1. A toner comprising toner particles, wherein the toner particles each include a toner mother particle containing a binder resin and an external additive attached to a surface of the toner mother particle, the external additive contains titanate compound particles doped with lanthanum and a group 5 element in the periodic table as external additive particles, an amount of the lanthanum is at least 1.50% by mass relative to a total mass of the titanate compound particles, and an amount of the group 5 element in the periodic table is at least 0.01% by mass and no greater than 0.60% by mass relative to the total mass of the titanate compound particles.

2. The toner according to claim 1, wherein the group 5 element in the periodic table is at least one element selected from the group consisting of vanadium, niobium, and tantalum.

3. The toner according to claim 1, wherein the titanate compound particles have a number average roundness of at least 0.79 and no greater than 1.00.

4. The toner according to claim 1, wherein the titanate compound particles are strontium titanate particles doped with the lanthanum and the group 5 element in the periodic table, barium titanate particles doped with the lanthanum and the group 5 element in the periodic table, or calcium titanate particles doped with the lanthanum and the group 5 element in the periodic table.

5. The toner according to claim 1, wherein an amount of the titanate compound particles is at least 0.1 parts by mass and no greater than 1.2 parts by mass relative to 100 parts by mass of the toner mother particles.

6. The toner according to claim 1, wherein an amount of the lanthanum is no greater than 15.00% by mass relative to the total mass of the titanate compound particles.

7. The toner according to claim 1, wherein the titanate compound particles have a number average primary particle diameter of at least 20 nm and no greater than 80 nm.

8. The toner according to claim 1, wherein the titanate compound particles have a relative dielectric constant of at least 100 and no greater than 1,200.

9. The toner according to claim 1, wherein the titanate compound particles each have a hydrophobized surface.

10. The toner according to claim 9, wherein the hydrophobized surface of each titanate compound particle has an alkyl group having a carbon number of at least 3 and no greater than 8.

* * * * *